United States Patent [19]

James

[11] 4,404,863

[45] Sep. 20, 1983

[54] COUNTERBALANCED PUMPS AND METHOD OF USING SAME

[75] Inventor: Robert G. James, Whittier, Calif.

[73] Assignee: Armco Inc., Middletown, Ohio

[21] Appl. No.: 220,435

[22] Filed: Dec. 29, 1980

[51] Int. Cl.[3] ..... F16H 29/02

[52] U.S. Cl. ..... 74/89.2; 74/89.22; 74/590; 74/591; 166/68; 187/94; 254/266; 417/415

[58] Field of Search ..... 417/15, 415; 187/94; 254/266; 74/89.2, 89.21, 89.22, 590, 591; 166/68, 75 R

[56] References Cited

U.S. PATENT DOCUMENTS

| | | | |
|---|---|---|---|
| 1,637,078 | 7/1927 | Hill | 74/590 X |
| 1,685,238 | 9/1928 | McDowell | 74/590 X |
| 1,923,012 | 8/1933 | Parker | 74/89.2 |
| 3,001,412 | 9/1961 | Babbitt | 74/89.21 |
| 3,285,081 | 11/1966 | Kuhns et al. | 74/89.22 |
| 3,528,305 | 9/1970 | Kuhns et al. | 74/89.22 |
| 3,695,117 | 10/1972 | Ewing et al. | 74/89.22 |
| 4,062,640 | 12/1977 | Gault | 74/89.22 X |
| 4,197,766 | 4/1980 | James | 74/89.2 |
| 4,251,059 | 2/1981 | Fougea | 254/266 X |

FOREIGN PATENT DOCUMENTS

| | | | |
|---|---|---|---|
| 1106380 | 7/1955 | France | 74/89.21 |

*Primary Examiner*—James Kee Chi

*Attorney, Agent, or Firm*—I. Michael Bak-Boychuk

[57] ABSTRACT

An oscillatory pumping system of the type having sheave chains wound in opposing directions over a mandrel, one sheave chain connecting to a rod string of a well and another supporting a counterbalance, is improved to include both rate and position sensors which, through a logic system control the application and reversal of power. The system is further improved by selection of geometry and in engagement features such that upon full playout of either chain the time of stroke reversal is shortened. This counterbalanced pumping system may be pivotally mounted on a tower thus allowing for installation of pump seals above ground.

10 Claims, 10 Drawing Figures

COUNTERBALANCED PUMPS AND METHOD OF USING SAME

BACKGROUND OF THE INVENTION

1. Field of the Invention

The invention relates to counterbalanced pumps and more particularly to improvements in the operation thereof.

2. Description of the Prior Art

In my prior U.S. patent applications Ser. Nos. 824,346 and 933,269, now U.S. Pat. Nos. 4,179,947 and 4,197,766, respectively, I have described a counterbalanced pump for use on oil wells wherein sheave or roller chains are spirally wound around mandrels connected for common rotation and as one chain is taken in, the other is concurrently played out. As result of the spiral stack-up of these sheave chains the one being taken in increases in effective moment arm about the common mandrel axis while the moment arm of the other decreases. By connecting one chain to a downhole pump rod string and the other to a counterbalance, a configuration results in which the kinematic effects (angular and linear momentum) are continuously exchanged with the static effects (moment arm), resulting in an oscillatory system. Thus only the work expended in friction and in bringing the well fluids to the surface has to be compensated.

In the foregoing system this power input has been found to be best achieved through a reversible electric motor turned on in the proper direction once the pump was sufficiently close to the synchronous motor rate. Thus the starting current levels in the motor could be reduced and the system could be operated closer to optimum efficiency.

In my further development I have found that additional power optimisation can be had by departing from essentially sinusoidal oscillations. It is therefore one object of the present invention to provide a geometric relationship in the counterbalanced system above described which effectively shortens the periods of reversal of the oscillatory stroke.

Furthermore, I have found that by monitoring the states of the pumping system logical controls may be exercised over the motor excitation periods to insure optimal current draw and to recognize anomalies. Thus my second object is to provide a logical system herein which both controls the cycling of power and which, furthermore, compares selected measurements to recognize a failure.

SUMMARY OF THE INVENTION

By way of background, a first and second mandrel are mounted and fixed to a common shaft which, in turn, is geared to be turned by a reversible electric motor. Wound in opposite directions around each mandrel is a sheave or roller chain and when the shaft is turned one of the chains is played out while the other is taken in. These chains may then respectively connect to a counter balance and to a rod string in a well across respective turning rollers which align the chain ends to appropriate vertical alignments.

In the foregoing configuration as the chains are spirally stacked around each mandrel their effective moment arms around the shaft increase. Thus the following results ensue:

(a) A static equilibrium point will be achieved even if some unbalance exists; and (b) dynamically an oscillatory system is produced since the momentum (angular and linear) is exchanged for moment arm.

By virtue of the oscillatory character of this pumping system it has thus been rendered possible to apply periodically power to the electric motor after some shaft rate is established by the inherent oscillations. This reduces the initial current flow normally associated with bringing an electrical motor up to speed.

The foregoing configuration may be further improved in the following manner:

(a) The chain lengths may be selected such that at the end of each stroke one chain is completely unwound from the mandrel. When thus unwound further travel of the mandrel will result in a condition where both chains oppose the direction of the stroke. Thus the reversals in each stroke are rendered much more abrupt or "peaky" allowing for much longer periods over which the shaft is essentially at speed.

(b) The shaft may be connected to rate and position measurement devices which may then provide the inputs to a microprocessor issuing, in a logical manner, the power switching inputs to the electrical motor.

It is these features that are set out herein. In the first instance a relationship is provided between the mandrel size, the size and alignment of the turning rollers and the length of the chain wound up which effect a short term reversal with minimal high frequency shock. Each mandrel, furthermore, is provided with a pivoted lever to which the end of the chain is attached. The reversing motion of this lever is opposed by a stop formed in the mandrel which comes into effect when the mandrel travels beyond its intended limit. When turned against the stop this lever effectively increases the radius of the mandrel, thus increasing the reversing torques. In this form the torque reversal may be effectively shaped to fully absorb any residual momentum and to provide the necessary impulse towards bringing the reverse portion of the stroke up to speed.

In the alternative each mandrel may be slidably mounted on the shaft and may thus rotate independent of the shaft. A stop extending radially from the shaft engages an oversized slot in the mandrel, thus allowing each mandrel to slide freely around the shaft over a selected increment of arc. By appropriate selection of chain length it is thus possible to form a condition where over certain segments of the stroke the two chains oppose each other while at the extreme limits the mandrels are unopposed over the arc increment.

In both of the foregoing alternatives the effect produced is to modify what has previously been a sinusoidal function to a function in which the stroke reversal periods are substantially reduced. This leaves substantially longer portions of the stroke for the application of power. The power thus can be spread over longer intervals reducing the size of the power plant and providing for more optimal conditions.

The system may be further improved by attaching a shaft encoder to the mandrels which then provides output signals indicative of shaft position. These signals may be fed to a logic stage controlling the switching states to the motor. While the logic stage may be variously implemented, a microprocessor appears best suited for the purpose. This microprocessor may then be loaded with a mathematical model of an idealized system and the power application intervals may then be controlled according to deviations from this ideal. Thus the power on time interval may extend up to the reversal, or beyond, allowing for the storage of energy which brings about a quicker return.

In any of its improved forms the pumping system may be installed on towers above ground level and will thus permit the installation of rod seals at the ground surface. To allow for maintenance the tower installation may include pivotal joints about which the system may be swung for convenience in access.

DESCRIPTION OF THE PREFERRED EMBODIMENTS

Figure 1:
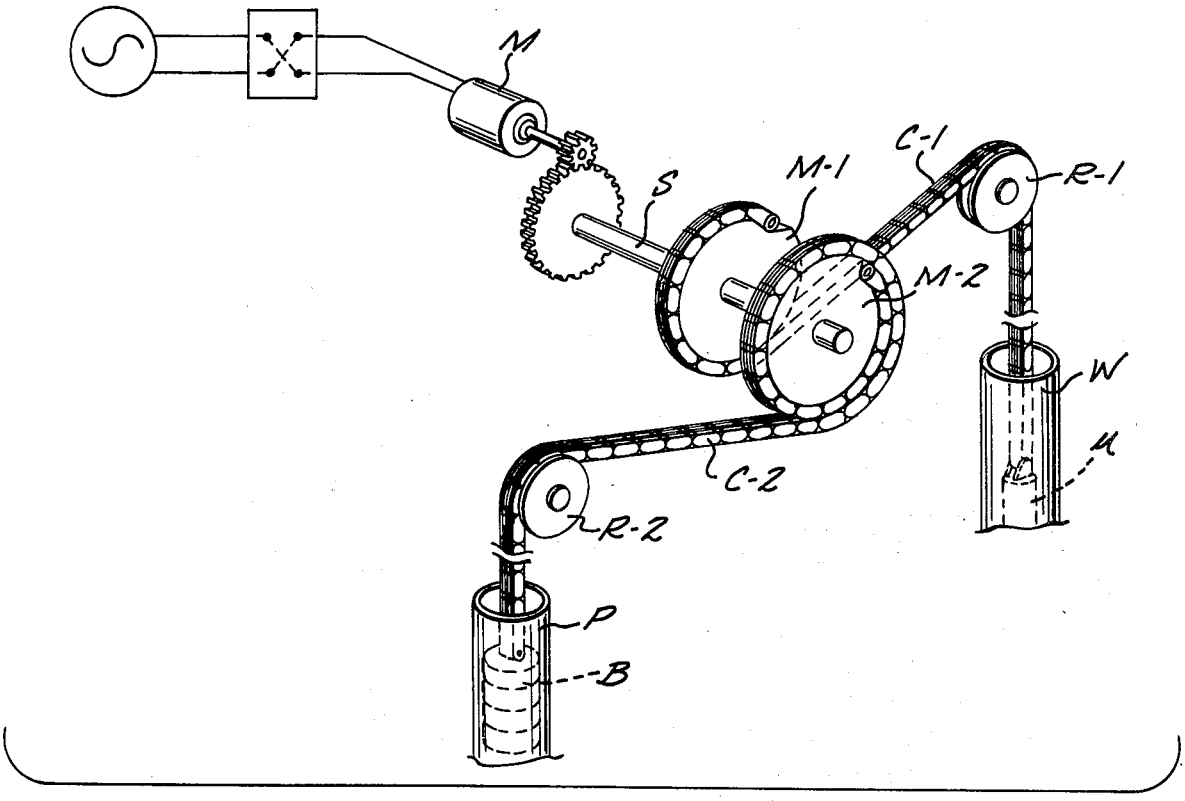
FIG. 1 is a perspective illustration of a counterbalanced pump to be improved according to the invention herein.

As shown in FIG. 1 a counterbalanced pumping system of the type described in U.S. Pat. Nos. 4,179,947 and 4,167,098 may be summarized as comprising a first mandrel M1 mounted on a shaft S which also supports a second mandrel M2. Shaft S may be geared or otherwise connected to a reversible electric motor M which thus drives both mandrels in rotation. Mandrels M1 and M2 each have wound thereabout, in opposing spiral wind sheave chains C1 and C2 respectively. Sheave chain C1 departs from mandrel M1 to a turning roller R1 whence it is routed into the interior of a well W to support a rod string U at the end thereof while chain C2 is turned about a roller R2 into a counterbalance pit P to support a counterbalance B therein.

By virtue of this arrangement the unwinding of the stacked ranks each chain results in an effectively smaller moment arm about the corresponding mandrel while the taking in of chain provides an opposite result. Thus as the rod string U descends into the well the moment arm of the counterbalance increases. Once set in motion this exchange of moment arm for momentum will contrinue as oscillations until dissipated by losses.

Figure 2:
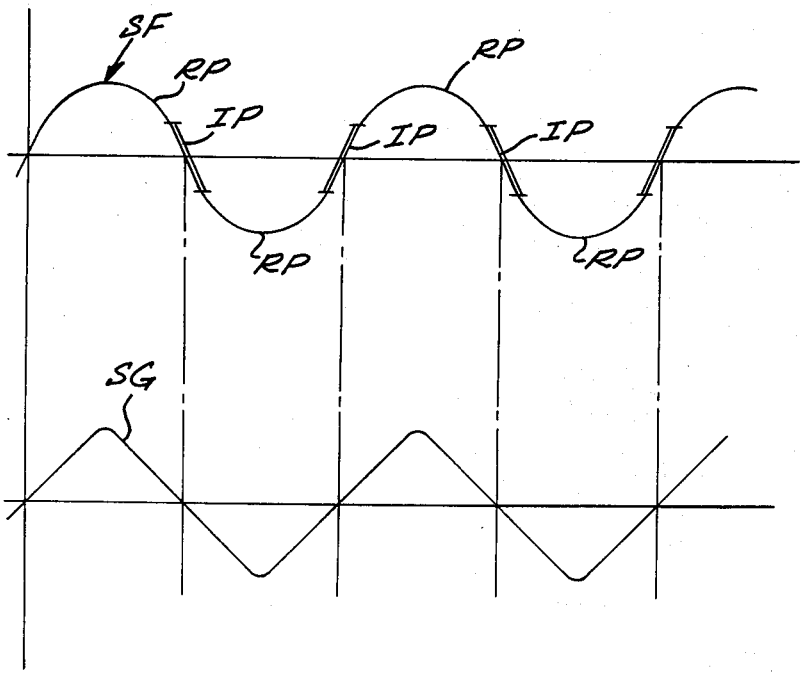
FIG. 2 is a chart of oscillatory functions illustrating the operative features herein.

In linearized form the resulting oscillatory motion of the above configuration approximates a sinusoidal wave form SF shown in FIG. 2. Because of the curvature of this function the periods during which energy can be added, shown as power increments IP, are limited. Specifically, the use of an electric motor M as the power source is best achieved at matched speed and the reversal periods RP would thus entail a shear stall condition. Accordingly, a more effective use of an electric motor can be made by modifying the wave form SF to a wave form in which the reversals are compressed. One such modified wave form is shown as the function SG.

Figure 3:
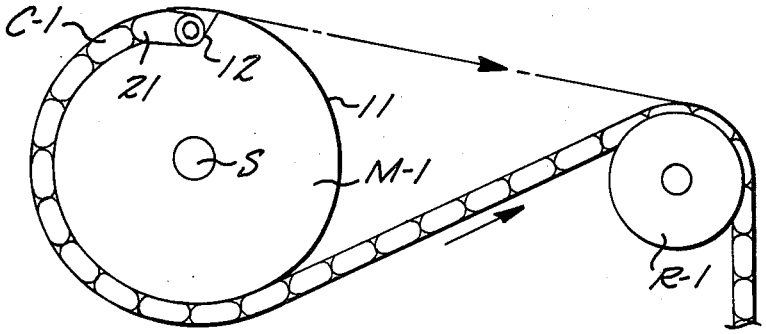
FIG. 3 is a plan view detail of the operative structure disclosed herein.

One implementation allowing for the compressed reversals is shown in FIG. 3. In this figure a single mandrel is illustrated, it being understood that the other mandrel be constructed in an identical manner but in opposed winding. As shown in FIG. 3 mandrel M1 includes a spiral periphery 11 which returns upon itself at a step 12. The depth of this step 12 is selected to match the thickness of the chain C1 thus forming a base onto which the successive ranks of the chain can be laid. A pivoted lever 21 is deployed within the crook between the step 12 and the periphery 11 and it is to this lever that the chain C1 is attached.

Figure 4:
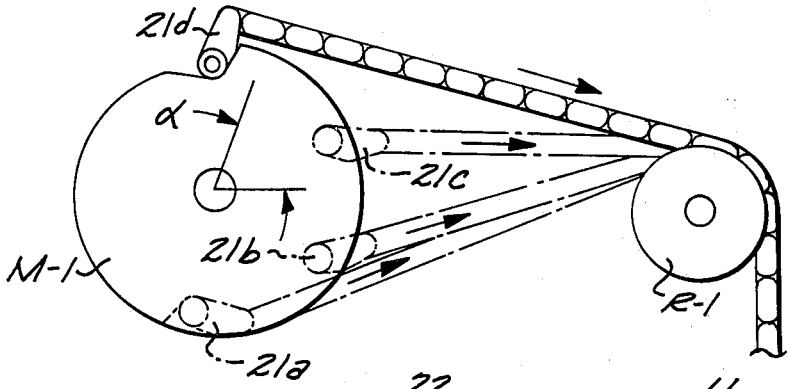
FIG. 4 is a sequence illustration of the method of operation set out herein.
Figure 5:
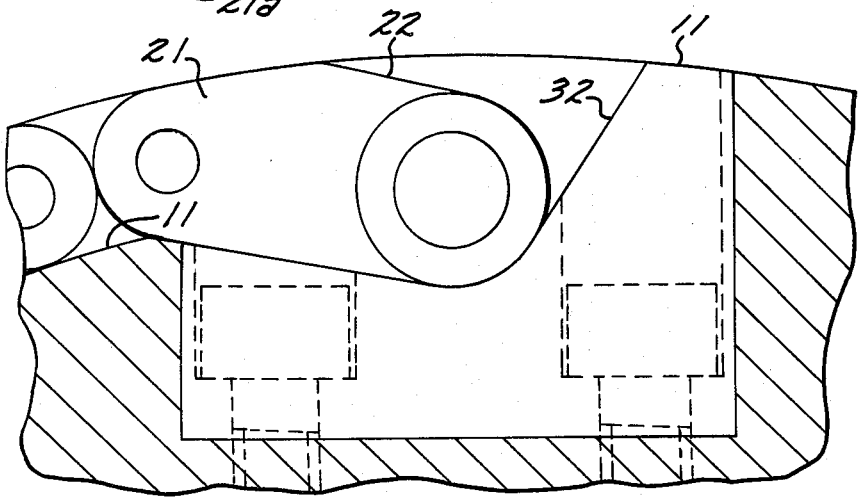
FIG. 5 is a detail illustration of a lever useful with the invention herein.

The foregoing link or lever 21 both provides the necessary articulation to meet the large span of chain departure angles at the end of chain deployment and further serves as a lever to accomodate any overtravel conditions. Specifically as shown in FIGS. 4 and 5 the pivoted end of lever 21 includes a flat surface 22 shaped to abut a similarly conformed surface segment 32 in the step 12. Accordingly, as the last rank of the chain is paid out the alignment of the lever successively passes from a state **21*a* to 21*b* then to 21*c* and finally to 21*d* at which point further angular changes are limited by the abutment of surfaces 22 and 32. At this last alignment state 21*d* the lever 21** acts to increase the moment arm about the center of the shaft S for all torques opposite to those normally applied through chain wind up.

Figure 6:
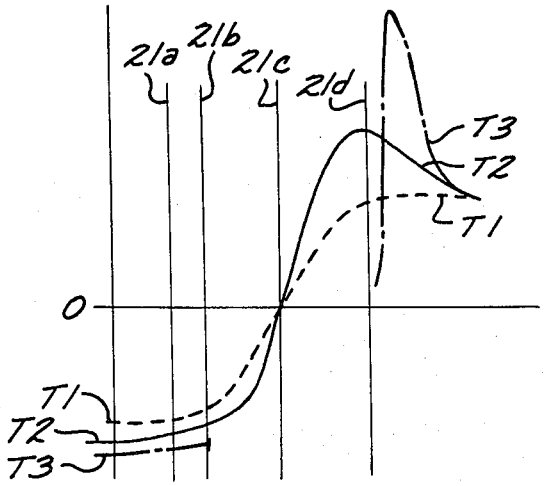
FIG. 6 is a graphical illustration of torque reversals incident to the various operative modes disclosed herein.

As result of the foregoing changes in state the torque levels about the shaft S follow the function shown in FIG. 6. In this figure it is to be understood that the torque about shaft S approximates according to the following relationship:

$$T = W\left(1 + \frac{1}{g}\ \frac{dv}{dt}\right) R \sin\alpha$$

where W is the weight on the end of the chain; g is the gravitational constant; dv/dt is the change in the linear velocity of the weight; $\alpha$ is the angle to which the lever is translated relative horizontal and R is the radius dimension from the shaft center to the lever. The resulting torque function T1 goes from a negative to a positive torque during the states **21*a*–21*d*. In turn the term dv/dt approximates $\alpha$ sin $\alpha$. Thus, for most realistic angles of $\alpha$ large torque components are dynamically produced because of this end of chain condition. These are effectively unopposed by the other chain C2** since no such reversals occur during the process of wrapping. Thus the condition is uniquely attributable to the events incident to the ending of the chain and may be used to produce torque levels sufficiently high to reverse the cycle under most conditions.

While the highly linearized above expression generally indicates the results obtained by running the chain to its end, further improvements are achieved by selection of geometry. For example, deployment of the turning roller R1 at a dimension between 3 and 6 radii of the mandrel improves the angles of departure. Combining the effect of unwrapping with that of the lever 21 and the proximity of the turning roller a torque function T2 is obtained over the states **21*a*–21*d*, illustrated in FIG. 6**. The superposition of this forcing function onto the chart SF shown in FIG. 2 obtains the desired function SG.

Figure 7:
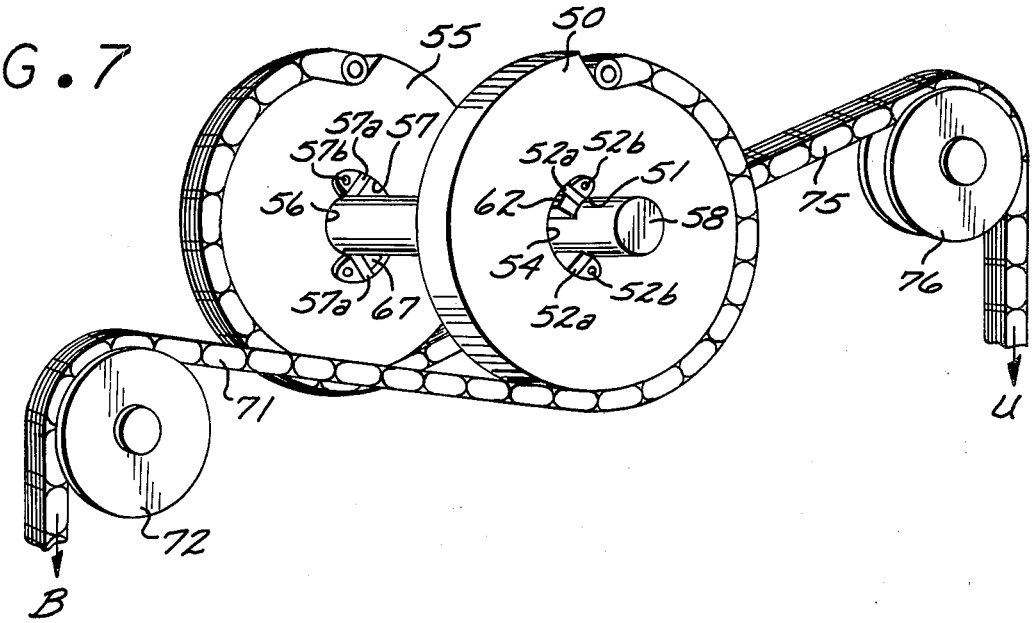
FIG. 7 is a perspective illustration of yet another embodiment for implementing the operative method set out herein.

In an alternative implementation essentially the same features may be obtained through the use of sliding engagement detents. As shown in FIG. 7 a mandrel 50 includes a central opening 51 which, along one peripheral segment thereof, includes a radial cut-out or enlarged keyway 54. Similarly, a second mandrel 55 may include a central opening 56 provided with a radial cutout 57. Both these mandrels are mounted on a cylindrical shaft 58 conformed to fit, in sliding engagement, the central openings 51 and 56. Formed on the shaft 58 are two radial projections 62 and 67 which are axially spaced to extend into the above mentioned cutouts 54 and 57 respectively. Each of the foregoing radial projection subtends an arc substantially smaller than the corresponding cutout, with the result that the mandrels 50 and 55 are free to rotate about the shaft 58 over the arc difference. Each mandrel, furthermore, stores in wrapped alignment a corresponding length of sheave chain 71 and 75 which is respectively turned over rollers 72 and 76 to support the pump string U and the counterbalance B.

As result of the above freedom of movement over the arc difference the imbalance in angular and linear momentum at the ends of each stroke is used to advantage. It is to be understood that the chains, as they wrap around the mandrel, add to the polar moment of inertia in the direction of wrap only. In the direction of unwrapping the chain ranks are free to spread radially to the extent the angular acceleration exceeds the linear acceleration of the weight or the pump. Because of this momentary unbalance the original sinusoidal function SF (in FIG. 2) is, once again, modified to approximate the curve SG.

Alternatively, the end of chain configuration above described may be combined with the alignment of slots 54 and 57. The arc conforming to the angle is thus determined by these slots. Within this arc the torque of the sliding mandrel is approximately zero and once the other limit is reached a reversing torque impulse accelerates the system to speed. The foregoing torque dead band function is illustrated in FIG. 6 as the curve T3.

The foregoing embodiment may, furthermore, include shock attenuating inserts **52*a* and 57*a* at the edges of cutouts 54 and 57 within which any impacts are dissipated to protect the chains. These inserts or pads 52*a* and 57*a* may be made of neoprene or other suitable elastic material and may be installed with fasteners 52*b* and 57*b*** to allow replacement for wear.

While the above description of the mechanical improvements is deemed to be complete, it is intended that reference be had to the patents above enumerated for the remaining apsects of the structure.

Figure 8:
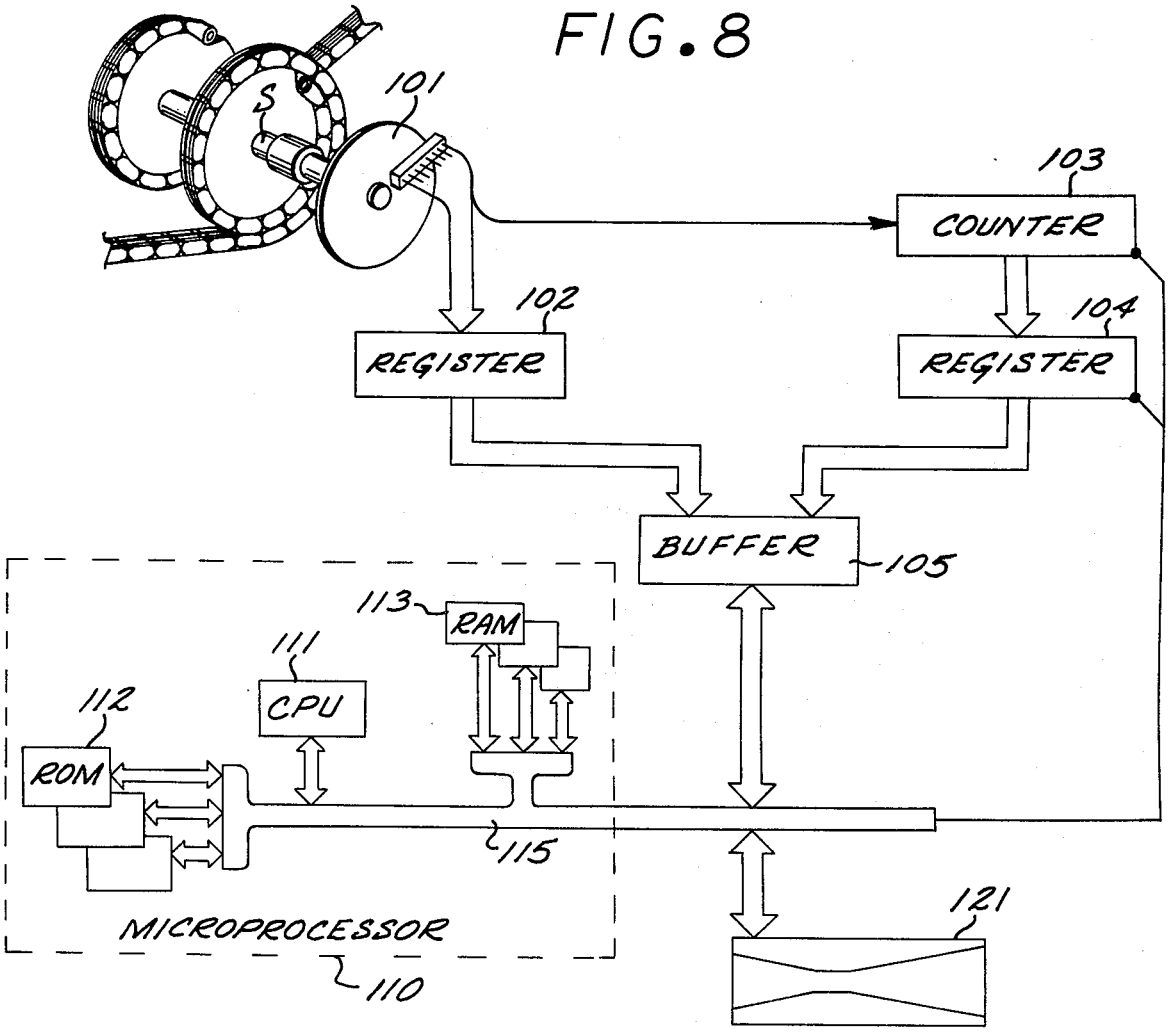
FIG. 8 is a diagram of a control system constructed according to the present invention.

In addition, the foregoing pumping system may be modified as shown in FIG. 8, to include a shaft encoder 101 at the end of shaft S. This shaft encoder may be any conventional binary series shaft encoder providing a parallel bit output to a register 102. The least significant bit lead of the output branch of this encoder may concurrently be connected to clock a counter 103 which is periodically cleared by a cyclic signal from a microprocessor 110 such as that produced by the Intel Corp., Santa Clara, Ca. under the model designation MCS-40. Such microprocessor generally includes a central processing unit (CPU) 111, an array of read-only-memories (ROMs) 112, and an array of random access memories (RAMs) 113 all interconnected by a main system bus 115. For the purposes herein bus 115 includes both the data and address buses as well as the many signal leads (not described) which are necessary to render the microprocessor 110 operable. Included further but not shown, in the above microprocessor system are the various status leads, clock and other functions commonly referred to as the housekeeping functions, which are best known through the reading of "Intel MCS-40 User's Manual for Logic Designers" by Intel, second edition, third printing, March, 1975.

Counter 103 is periodically loaded into a register 104 which, through a buffer 105, connects to bus 115. The same buffer 105 also receives the output of register 102, selected according to the state of the microprocessor. Furthermore, registers 102 and 104 may be periodically cleaned after each buffer reading.

Thus the angular position of the shaft and the bit rate of the least significant encoder rank are provided to the microprocessor on a cyclic basis. Since the cycle rate of such a microprocessor is grossly faster than any mechanical functions in the pump sequential manipulation of this data may occur in the CPU 111. The CPU may then compare the angular position and rate against data arrays stored in ROMS 112 to provide a difference or departure from an idealized model. Based on this difference control signals may then be issued to the motor M.

Again, because of the gross missmatch between the operating rates additional logical comparisons can be made. For example, the output of a flow meter 121 may be combined with the deviation to detect either a pump off state or a mechanical failure. Either a pump off state or a mechanical failure may dictate the termination of motor input.

In the above control implementation some of the ROMS 112 may be loaded, for example, with the function SG addressed by the clock. This predicted function may then be compared against the output of encoder 101 and the error or difference therebetween may be used to delay the motor M shutdown. Thus the motor M may be used to impart additional energy to the system to carry into effect the end of chain condition described. Furthermore, the rate output in register 104 may be used to start the motor in each cycle to effect a close match with synchronous speed.

In this manner both the start and shutdown of motor M is closely controlled allowing for operation close to optimum.

Figure 9:
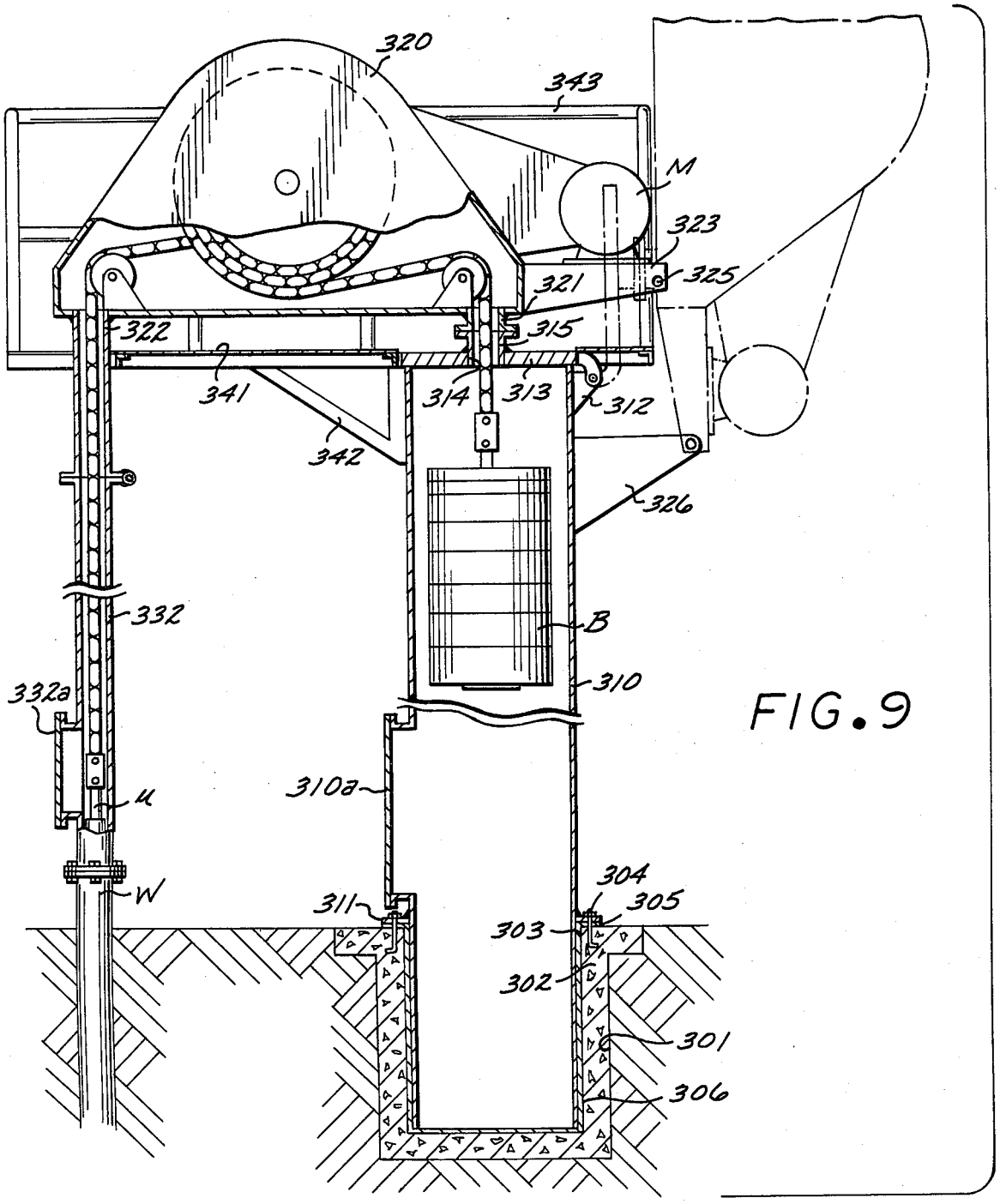
FIG. 9 is a side view of a tower structure on which the pumping system is mounted.
Figure 10:
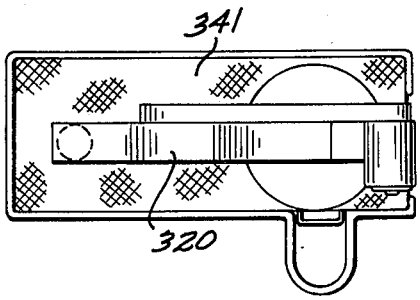
FIG. 10 is a top view of the tower structure shown in FIG. 9.

The foregoing pumping system may be mounted on a tower structure according to the illustrations shown in FIGS. 9 and 10. As shown in these drawings a base well 301 may be dug in the ground to a depth slightly larger than the counterbalance stack. This well may then be lined with a poured or cast cement liner 302 having an upper circular opening 303 about which a plurality of anchor bolts 304 are imbedded. These anchor bolts 304 may pass through a peripheral flange 305 formed around the opening of a metal insert 306 conformed for insertion into the liner. A main mounting tube 310 is then inserted into the common liner and insert cavities and projects vertically therefrom. Tube 310 includes a peripheral flange 311 which rests on the periphery of the insert and is secured to the liner by the anchor bolts. In this installation the tube 310 forms a main vertical member of the mounting structure set out.

At the upper end tube 310 is provided with a pivot mount 312 from which a circular cap 313 is hinged. This circular cap includes a central opening 314 into which a tube segment 315 is welded. It is this tube segment 315 that is attached to the counterbalance output port 321 of a counterbalanced pump housing 320 in which the counterbalanced pump described above is contained. Housing 320 may include a cantelevered platform 323 on which the motor M is mounted and which includes at the free edge thereof a transverse hole 325 which, upon the pivoting of the housing 320 and cap 313 about the pivot 312, aligns with a lock detent 326 on the exterior of tube 310.

At the other or free end housing 320 includes a tube segment 322 extending downwardly to form the port for the chain extending into the interior of the well. The lower or free end of tube segment 322 is hinged to the end of a pivoted tube section 332 which connects to the well W. It is to be understood that the above tube elements include appropriate end flanges and once aligned in position may be thus secured.

Tube 310 and section 332 may include lateral access panels 310*a* and 332*a* respectively through which the counterbalance B and the rod string U may be serviced. Should major work be necessary, such that entailing the withdrawal of the sucker rods, the housing 320 together with the cap 313 may be pivoted about pivot 312 to align the hole 325 in the cantelevered platform 323 with the lock detent 326 where it is pinned, as shown in the phantom line diagram of FIG. 9.

In addition to the above features, cap 313 may be attached to a walkway 341 supported on the underside with a triangulating bracework 342 which, when in position, abuts the side of tube 310 opposite the pivot. This same walkway may include railing 343 around its periphery which moves together with the cap as an integral assembly.

The above mounting structure is conveniently suited for hard rock terrains where the digging of deep counterbalance pits presents a major expense. The same base well that is necessary for proper foundation also serves to accommodate the counterbalance stack thus raising the system to the height of the stroke which concurrently, allows for the placement of rod seals (not shown) at the ground surface.

Obviously many modifications and changes may be made to the foregoing without departing from the spirit of the invention. It is therefore intended that the scope of the invention be determined solely on the claims appended hereto.

What is claimed is:

1. In a counterbalanced pumping system having a set of sheave chains wound in opposing directions over mandrels, said sheave chains supporting a pump rod string and a counterbalance, and a motor operatively engaged to maintain said mandrels in oscillation, the improvement comprising:

said sheave chains having ends pivotally secured to said mandrels and having lengths selected for full unwinding of one upon the reversal of the other; and turning means mounted proximate said mandrels for supporting said sheave chains and for aligning the ends thereof to a vertical alignment, said turning means being aligned relative said mandrels to produce a torque reversal thereabout upon the full unwinding of each sheave chain.

2. Apparatus according to claim 1 wherein:

said motor is an electrical motor selectively engaged to said mandrels to fully unwind said sheave chains.

3. Apparatus according to claim 1 further comprising:

pivotal links respectively connected between said sheave chains having a first alignment limit relative said mandrels when said sheave chains are wound thereabout and a second alignment limit when said sheave chains are unwound, said first limit being substantially along a tangent of said mandrels and said second limit being along a radius thereof.

4. Apparatus according to claim 1 wherein:

said mandrels are free to rotate relative each other over a predetermined arc segment.

5. Apparatus according to claim 2 further comprising:

sensing means connnected to said mandrels for producing position signals indicative of the angular position thereof; and logical computing means connected to receive said position signals from said sensing means for converting said position signals to rate signals indicative of the angular rate of said mandrels, said computing means being connected to said motor for engaging thereof over a predetermined combination of said position and rate signals.

6. Apparatus according to claim 5 wherein:

said sensing means is a shaft encoder; and said computing means is a microprocessor.

7. In a counterbalanced pumping system having a set of sheave chains wound in opposing directions over mandrels, said sheave chains supporting a pump rod string and a counterbalance, and a motor operatively engaged to maintain said mandrels in oscillation, the improvement comprising:

sensing means connected to said mandrels for producing position signals indicative of the angular position thereof; and logical computing means connected to receive said position signals from said sensing means for converting said position signals to rate signals indicative of the angular rate of said mandrels, said computing means being connected to said motor for engaging thereof over a predetermined combination of said position and rate signals.

8. Apparatus according to claim 7 wherein:

said sensing means is a shaft encoder; and said computing means is a microprocessor.

9. A method for reducing the reversal periods of a counterbalanced pump having a set of sheave chains wound in opposing directions over mandrels, said sheave chains supporting a pump rod string and a counterbalance, and a motor operatively engaged to maintain said mandrels in oscillation, comprising the steps of:

driving said motor to unwind one of said sheave chains; and coasting said mandrels to wind said one sheave chain in the same direction as the other.

10. In a counterbalanced pumping system having a set of sheave chains wound in opposing directions over mandrels, said sheave chains supporting a pump rod string and a counterbalance, and a motor operatively engaged to maintain said mandrels in oscillation, the improvement comprising:

support means for raising said pumping system above ground including a first tubular structure conformed to receive one of said chains and mounted to extend vertically above ground, a pivot formed on the upper end of said first tubular structure, a housing pivotally joined on one end to said pivotal structure said housing being conformed to receive said pumping system, a second tubular structure hinged to the other end of said housing, said first structure being partly received in ground while the second structure being attached to a well head.

* * * * *